US006941924B2

(12) United States Patent
Morii et al.

(10) Patent No.: US 6,941,924 B2
(45) Date of Patent: Sep. 13, 2005

(54) ARRANGEMENT AND STRUCTURE OF AUXILIARIES IN A SNOWMOBILE ENGINE

(75) Inventors: Hideshi Morii, Hamamatsu (JP); Yasuaki Yatagai, Hamamatsu (JP); Yutaka Sasaki, Hamamatsu (JP); Ken Shibano, Hamamatsu (JP); Hitoshi Matsumura, Hamamatsu (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 51 days.

(21) Appl. No.: 10/201,294

(22) Filed: Jul. 24, 2002

(65) Prior Publication Data

US 2003/0019464 A1 Jan. 30, 2003

(30) Foreign Application Priority Data

Jul. 27, 2001 (JP) ..... 2001-227772
Aug. 28, 2001 (JP) ..... 2001-257846

(51) Int. Cl.[7] ..... F02B 77/00
(52) U.S. Cl. ..... 123/198 R; 180/182
(58) Field of Search ..... 123/198 R, 195 A, 123/195 R; 180/182, 190

(56) References Cited

U.S. PATENT DOCUMENTS 5,063,897 A * 11/1991 Okui et al. ..... 123/198 R
5,269,142 A 12/1993 Atake
5,279,381 A * 1/1994 Fukuda ..... 180/190
5,424,183 A 6/1995 Ishida et al.
5,678,516 A * 10/1997 Sakurai ..... 123/198 R
5,938,963 A 8/1999 Tanis
6,186,109 B1 * 2/2001 Matsuno ..... 123/192.1
6,244,239 B1 * 6/2001 Sisco et al. ..... 123/198 R
6,418,887 B1 7/2002 Okamoto
6,454,037 B1 * 9/2002 Atsuumi et al. ..... 180/190
6,508,211 B1 1/2003 Asano
6,510,912 B1 1/2003 Atsuumi
6,547,021 B1 4/2003 Kai et al.
6,561,297 B2 * 5/2003 Yatagai et al. ..... 180/190
6,644,261 B2 11/2003 Morii et al.
2002/0100631 A1 8/2002 Nishijima
2002/0112909 A1 8/2002 Nishijima
2003/0029658 A1 2/2003 Etou
2003/0029659 A1 2/2003 Etou
2003/0029663 A1 2/2003 Etou
2003/0146032 A1 8/2003 Yatagai et al.
2003/0150658 A1 8/2003 Nakano et al.
2003/0164259 A1 9/2003 Morii
2003/0213637 A1 11/2003 Moriyama

FOREIGN PATENT DOCUMENTS

JP 2001-199380 A 7/2001
JP 2001-207820 A 8/2001

* cited by examiner

*Primary Examiner*—Mahmoud Gimie
*Assistant Examiner*—Katrina Harris
(74) *Attorney, Agent, or Firm*—Nixon & Vanderhye, P.C.

(57) ABSTRACT

In a snowmobile, a four-cycle engine has an alternator as a generator while the snowmobile body has heat exchangers through which the cooling water of the engine is cooled by heat exchange with external air and snow, in a front part and at the ceiling of a crawler house. The alternator is positioned between the four-cycle engine and the front heat exchanger. Further, an exhaust manifold is arranged at an upper position in front of the engine body while an approximately cylindrical oil filter is provided under the exhaust manifold and inclined forwards in the vehicle's direction of travel.

21 Claims, 13 Drawing Sheets

ARRANGEMENT AND STRUCTURE OF AUXILIARIES IN A SNOWMOBILE ENGINE

BACKGROUND OF THE INVENTION (1) Field of the Invention

The present invention relates to a snowmobile engine, in particular, relating to an arrangement and structure of auxiliaries in a snowmobile four-cycle engine. In more detail, the present invention is directed to an arrangement and structure of an alternator, oil filter and the like in a four-cycle engine mounted in a snowmobile.

(2) Description of the Prior Art

Conventionally, most snow vehicle such as snowmobiles and the like use two-cycle engines, which are relatively simple in structure, light and compact and yet powerful. Recently, however, because of regulation of exhaust gas or aiming at improvement in reduction of fuel consumption, there is a trend toward employing four-cycle engines. In contrast to two-cycle engines, which are compact and high in power, four-cycle engines need a camshaft and oil lubrication, inevitably tending towards large size. Further, since a four-cycle engine has to have valve gears for driving intake and exhaust valves and auxiliaries such as an oil filter for oil filtration, which also forces the engine to be large in size.

Taking these situations into account, in order to keep the engine room at the same size and shape as that when two-cycle engine is mounted, it is necessary to not only consider the oil pan configuration and the layout of intake and exhaust systems including the exhaust manifold but also closely examine the layout of associated auxiliaries such as the oil filter and the like.

It is necessary to provide a contrived layout of the oil pan configuration, intake and exhaust systems and associated auxiliaries, in order to make the body and engine hood of a snowmobile equipped with a four-cycle engine have a similar size to that of a two-cycle engine.

Also, as a generator for supplying electric power to the ignition and engine auxiliaries, a flywheel magneto and alternator are needed. Since this flywheel magneto is attached to the crankshaft end, the size of the engine in the shaft direction is enlarged, and the inertia of the crankshaft is increased, which leads to the disadvantage of lower acceleration performance.

The alternator is generally actuated by a belt which is driven by the drive force of the crankshaft. This arrangement enlarges the size of the engine perpendicular to the crankshaft, or the front-to-rear dimension, so that the alternator needs to be manipulatively and optimally laid out. It is also necessary to devise reduction of the front-to-rear dimension of the engine by optimizing the positional relationship between the alternator and the water pump which are both driven by the belt. When the engine is laid out in front of the steering shaft, there is a possibility of the steering shaft interfering with the auxiliaries such as alternator etc.

While the engine mounted in the snowmobile is covered by the engine hood, the flow of air is usually taken in to the engine room within the hood in order to cool the engine during travel. However, snow, together with the flow of air during travel, may sift into the engine room and cause trouble in the alternator, which is an electrical part. Therefore, the alternator is preferably disposed at a position away from influence snow during travel.

Further, a compact layout of these associated auxiliaries alone simply packs together the intake, exhaust systems and auxiliaries with the oil filter (which in particular needs frequent replacement), eliminating any spatial margin. Accordingly, replacement of the oil filter becomes impossible unless other parts arranged around the oil filter are removed, resulting in an increase in work load.

SUMMARY OF THE INVENTION

The present invention has been devised in view of the above prior art drawbacks, it is therefore an object of the present invention to provide an arrangement and structure of auxiliaries in a snowmobile engine, wherein the front-to-rear size of the whole engine to be mounted to a snowmobile can be reduced by carefully arranging the auxiliaries such as an alternator etc., so that the engine will not interfere with the steering post and other components, wherein the center of gravity of the vehicle can be set at a position close to the body center by arranging the engine close to the body center so that the maneuverability can be improved, and wherein no ill-effect to the auxiliaries will occur even if snow sifts, into the engine room.

It is another object of the present invention to provide an arrangement and structure of an oil filter in a four-cycle snowmobile engine, which facilities replacement of the oil filter without removal of other parts and yet can provide a layout as compact as that when a two-cycle engine is mounted.

The present invention has been devised in order to attain the above objects and is configured as follows:

In accordance with the first aspect of the present invention, an arrangement and structure of auxiliaries in a four-cycle snowmobile engine mounted in an engine room located on a front body and in front of a seat, is characterized in that the engine is mounted with the crankshaft thereof arranged along the body width direction; an alternator is disposed between the engine and a heat exchanger; a timing belt is wound between a pulley fitted on the crankshaft on the side opposite to that where an engine clutch mechanism is disposed and a pulley for alternator driving so that the alternator is driven by the rotation of the crankshaft.

In accordance with the second aspect of the present invention, the arrangement and structure of auxiliaries in a four-cycle snowmobile engine, having the above first feature is characterized in that the alternator is positioned over the oil pan.

In accordance with the third aspect of the present invention, the arrangement and structure of auxiliaries in a four-cycle snowmobile engine, having the above first feature is characterized in that the engine has an intake system including an intake manifold connected to an intake port on the rear side of the cylinder head and an exhaust system including an exhaust manifold connected to an exhaust port on the front side of the cylinder head, and the alternator is disposed below the intake manifold.

In accordance with the fourth aspect of the present invention, the arrangement and structure of auxiliaries in a four-cycle snowmobile engine, having the above first feature is characterized in that a steering device including a steering post with handlebars on top is arranged penetrating through the engine room while the alternator is arranged at the side of the steering post when viewed from the front of the vehicle.

In accordance with the fifth aspect of the present invention, the arrangement and structure of auxiliaries in a four-cycle snowmobile engine, having the above first feature is characterized in that a water pump and the alternator are arranged in front and in the rear, respectively, at positions approximately symmetrical to each other with respect to the engine cylinder axis.

In accordance with the sixth aspect of the present invention, an arrangement and structure of auxiliaries in a four-cycle snowmobile engine mounted in an engine room located on a front body and in front of a seat is characterized in that the four-cycle engine has an exhaust manifold arranged at an upper position on the front side of the engine body while an oil filter having an approximately cylindrical shape is arranged under the exhaust manifold and tilted forwards, in some degrees, in the vehicle's direction of travel.

In accordance with the seventh aspect of the present invention, the arrangement and structure of auxiliaries in a four-cycle snowmobile engine, having the above sixth feature is characterized in that the engine body has a cylinder block on top of a crankcase while the exhaust manifold is arranged on the front side of the cylinder head on top of the cylinder block, and the oil filter is arranged in front of the cylinder block under the exhaust manifold and tilted so as to avoid interference with the exhaust manifold.

In accordance with the eighth aspect of the present invention, the arrangement and structure of auxiliaries in a four-cycle snowmobile engine, having the above sixth feature is characterized in that steering rods extended forwards from a lower position of the engine body are coupled to the lower end of a steering post arranged in the rear of the engine body while the oil filter is positioned in the space enclosed, in the side view of the vehicle, by the crankshaft of the engine body, exhaust manifold and steering rods.

In accordance with the ninth aspect of the present invention, the arrangement and structure of auxiliaries in a four-cycle snowmobile engine, having the above sixth feature is characterized in that a water pump is arranged between the oil filter and exhaust manifold and the oil filter is tilted so as to avoid its interface with the water pump.

In accordance with the tenth aspect of the present invention, the arrangement and structure of auxiliaries in a four-cycle snowmobile engine, having the above seventh feature is characterized in that a muffler is disposed in front of and a distance apart from, the engine body while the connecting pipe that joins the muffler and the exhaust manifold is off-centered to one side from the center of the engine body with respect to the body width direction, so as to create a work space for oil filter replacement.

According to the present invention, the following effects can be obtained.

First, according to the present invention, since the alternator is arranged between the engine and heat exchanger, no snow or rain will strike the alternator if the flow of air is conducted into the engine hood (into the engine room) during travel. Accordingly, it is possible to prevent the possibility of inconveniences arising due to exposure of the alternator to water from snow and rain.

Since the alternator is driven together with the water pump by the common timing belt, the number of driving parts can be reduced.

Also in the present invention, the alternator is arranged in a space under the intake manifold so that it can be prevented from interference with the intake system. Further, if snow and water, entering the engine room together with a flow of air during travel, tends to come around and over the engine, the intake manifold plays a role of a shield, to thereby prevent snow and the like from wetting the alternator, in a reliable manner.

In the present invention, since it is possible to avoid interference between the steering post and the alternator when the four-cycle engine needs to be arranged as far rearwards as possible within the engine hood, it is possible to dispose the engine at a position most rearwards in the engine room, to thereby make the center of gravity of the engine close to that of the vehicle body.

Additionally, in the present invention, replacement of oil filters can be performed by making access to the front of the engine body, avoiding the exhaust manifold which is arranged at an upper position in front of the engine body. Further, replacement of oil filters can be easily performed without the necessity of removing other components while it is possible to achieve a layout of a four-cycle engine as compact as that when a two-cycle engine is mounted.

Finally, replacement work of oil filters will never be obstructed by the water pump.

DESCRIPTION OF THE PREFERRED EMBODIMENTS

The embodiments of the present invention will hereinafter be described in detail with reference to the accompanying drawings.

Figure 1:
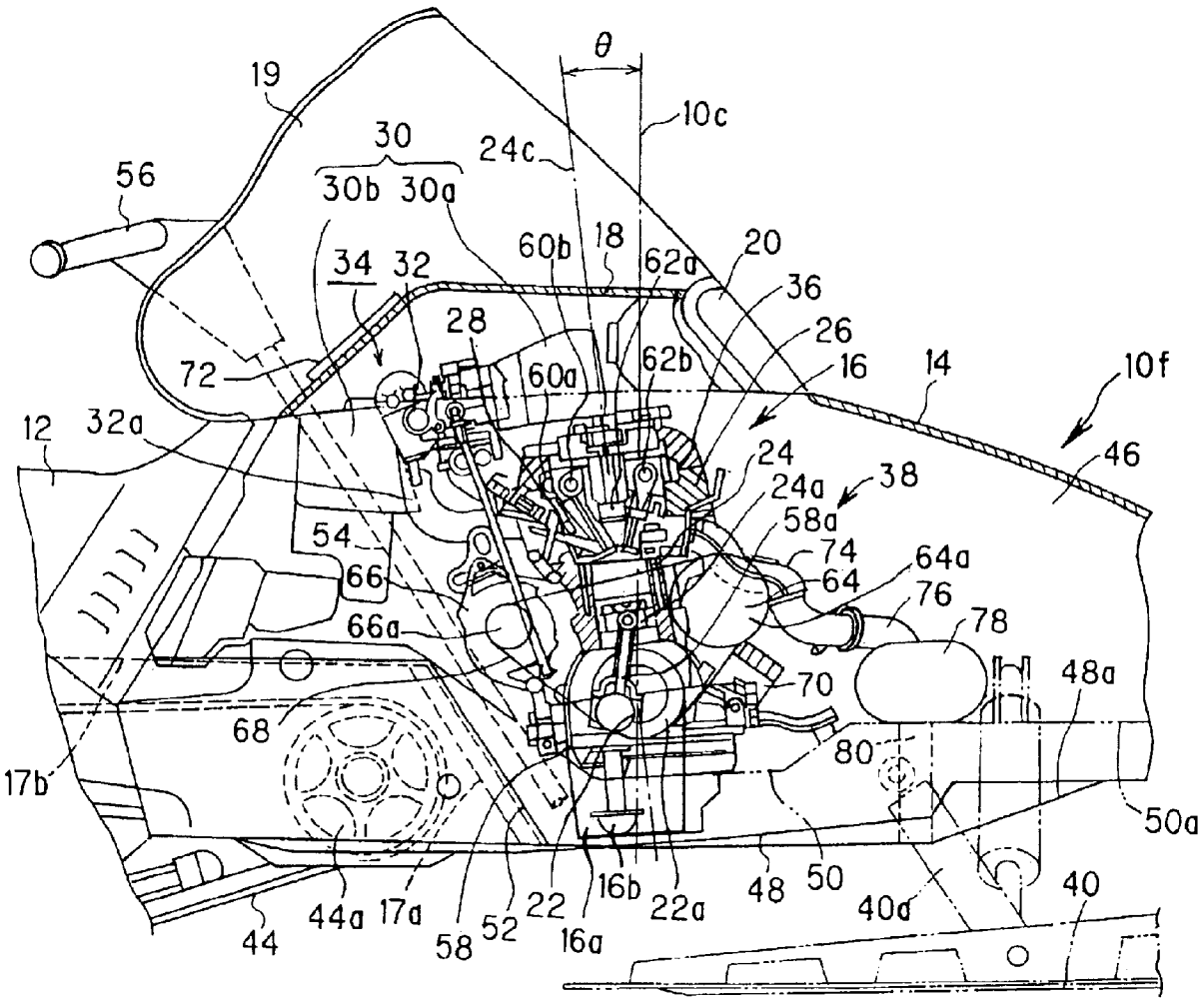
FIG. 1 is an enlarged illustrative side view showing the front part of a snowmobile equipped with a four-cycle engine which is applied to the first embodiment of the present invention.
Figure 2:
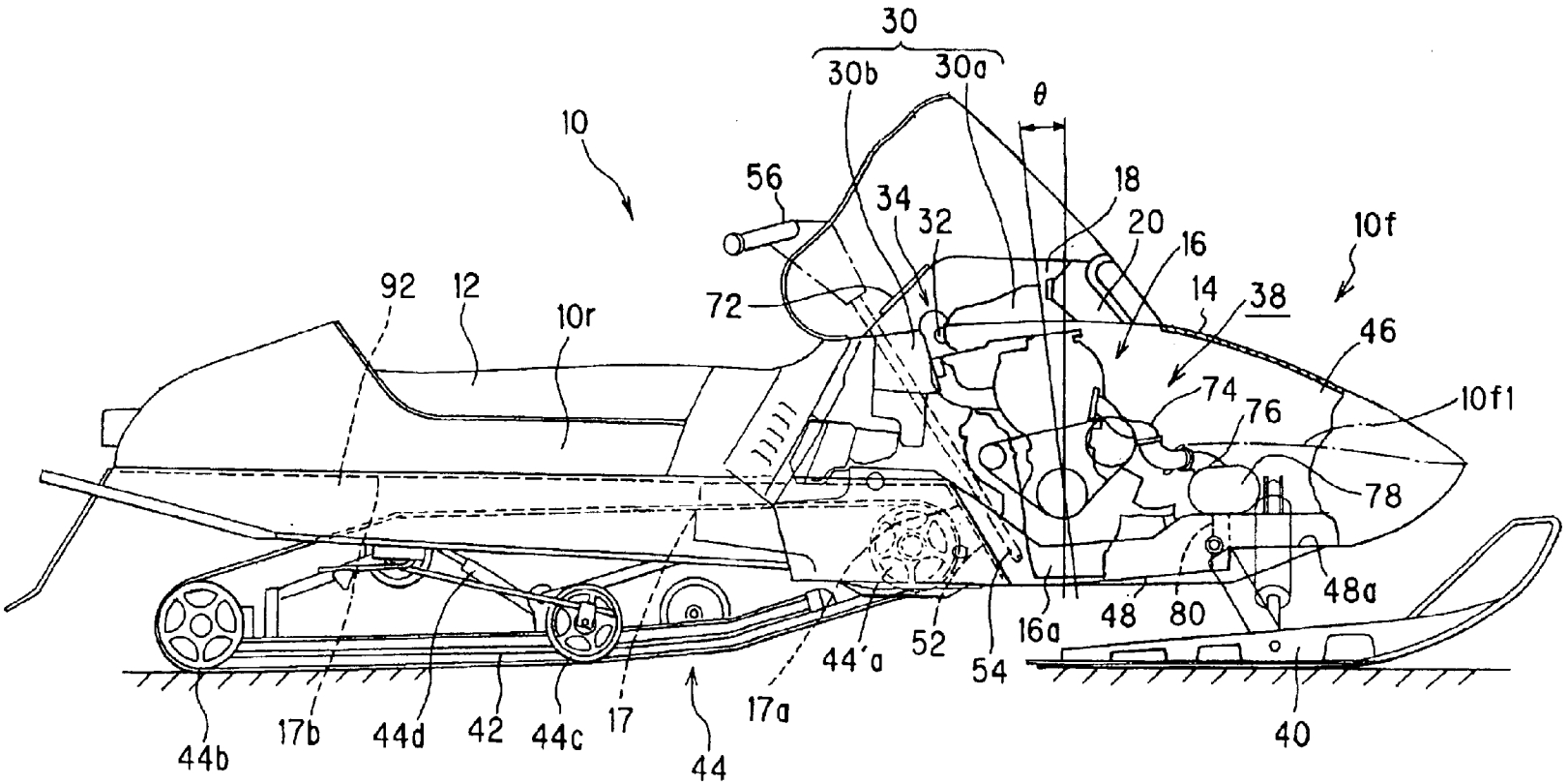
FIG. 2 is an illustrative side view showing the overall configuration of the same snowmobile.
Figure 3:
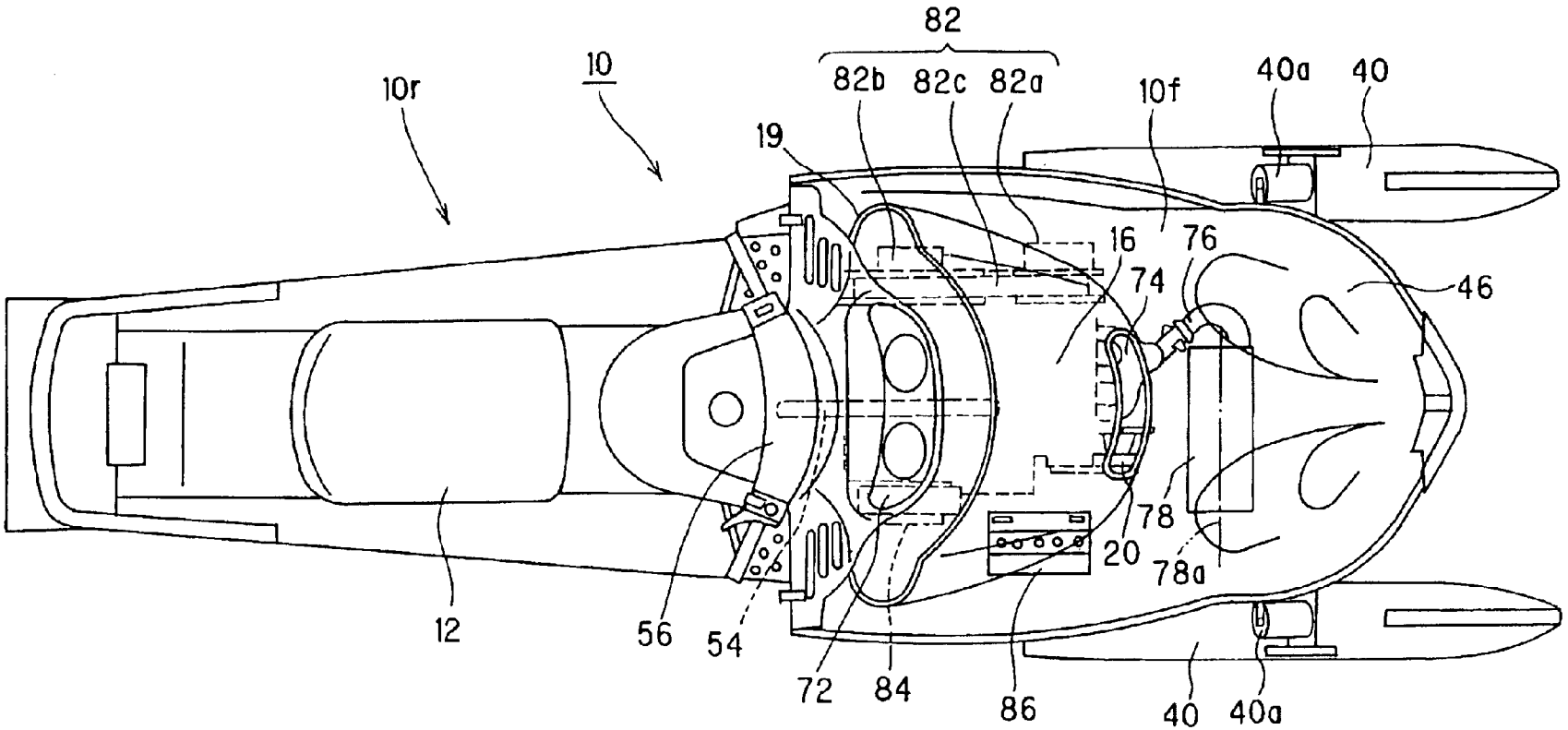
FIG. 3 is an illustrative plan view showing the overall configuration of the same snowmobile.
Figure 4:
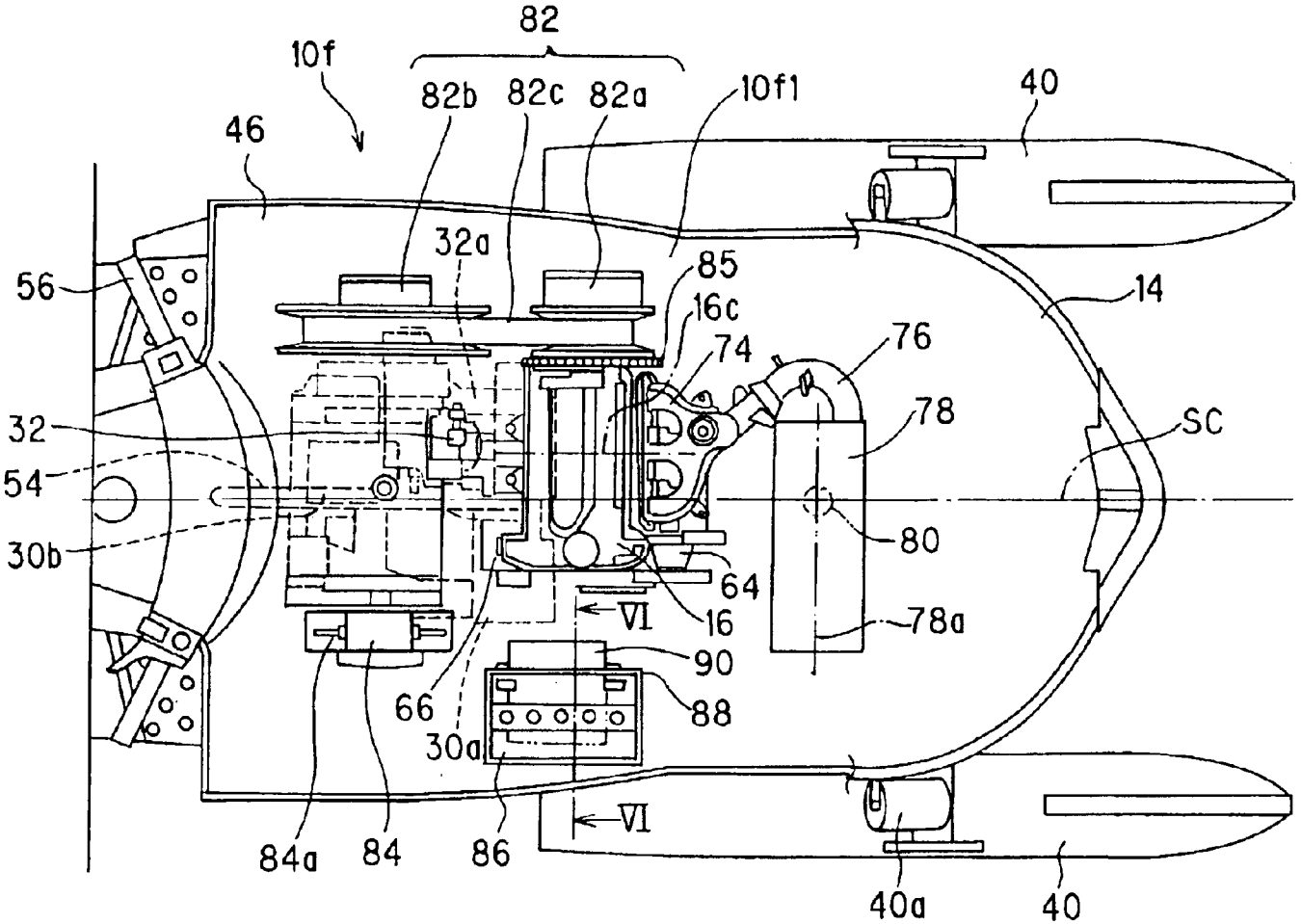
FIG. 4 is an enlarged illustrative view showing the detail of FIG. 3.
Figure 5:
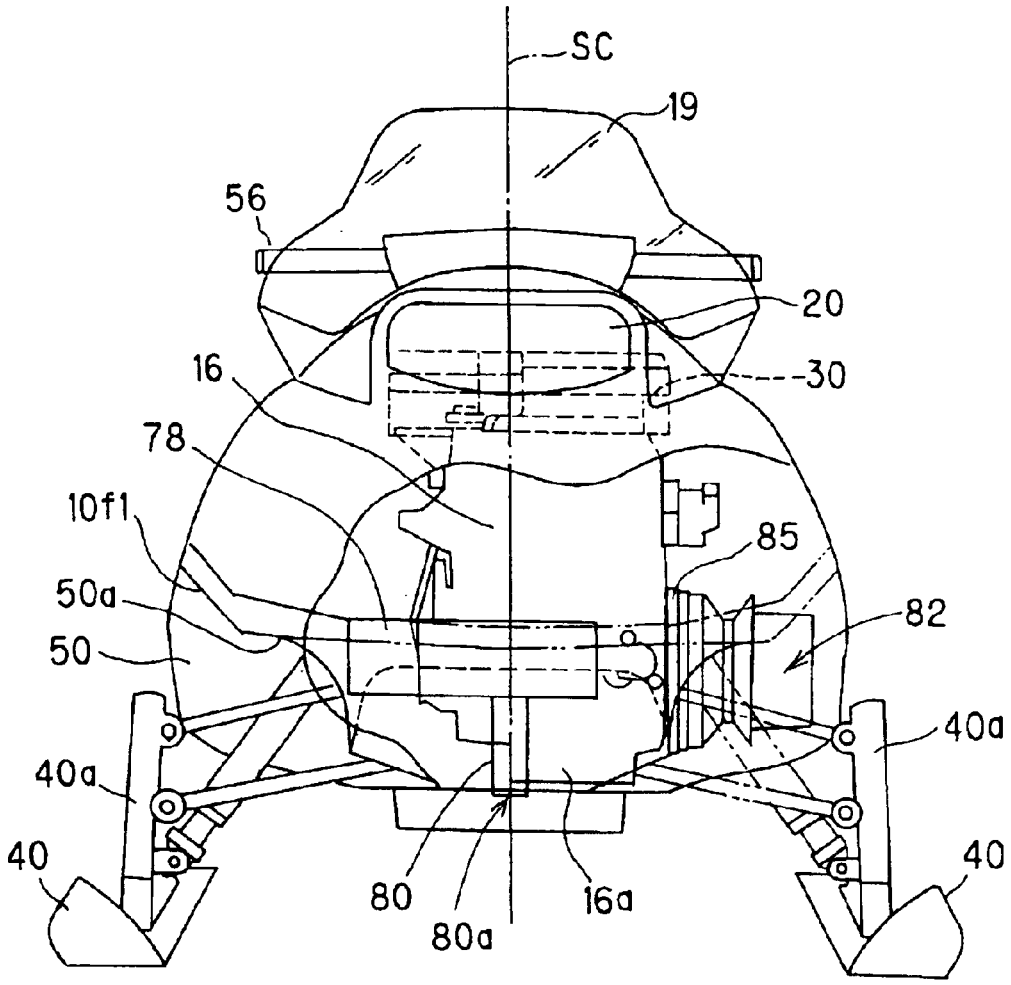
FIG. 5 is an illustrative front view showing a snowmobile.
Figure 6A:
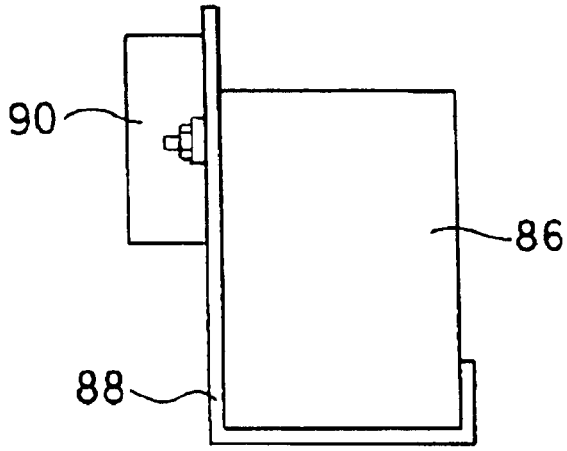
FIGS. 6A and 6B are illustrative layout views of a battery, cut along a VI—VI plane in FIG. 4.
Figure 6B:
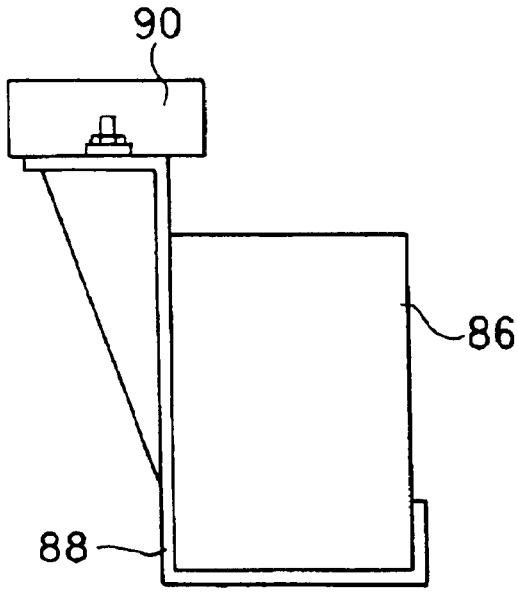
Figure 7A:
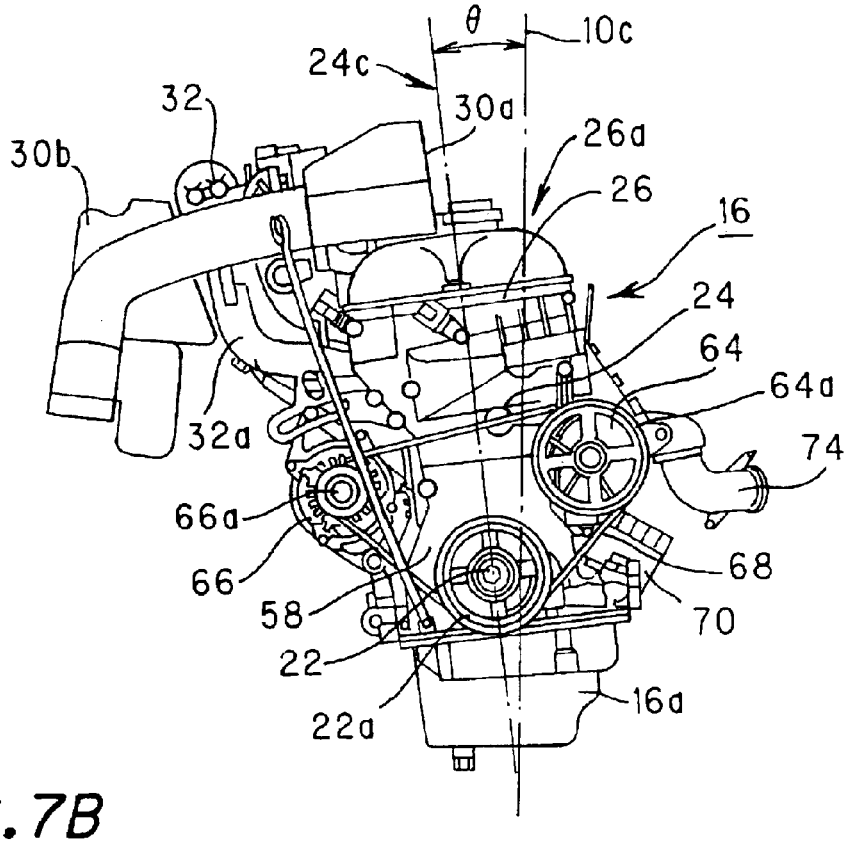
FIGS. 7A and 7B are external side view and front view, showing the four-cycle engine.
Figure 7B:
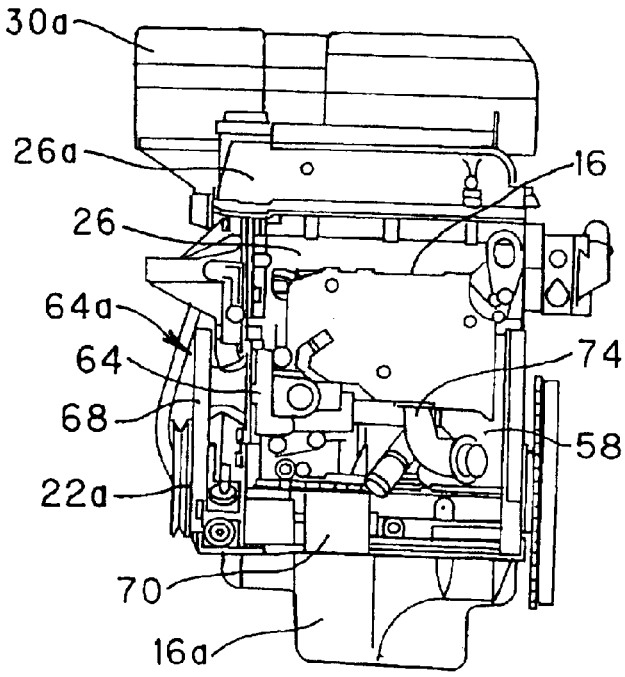
Figure 8:
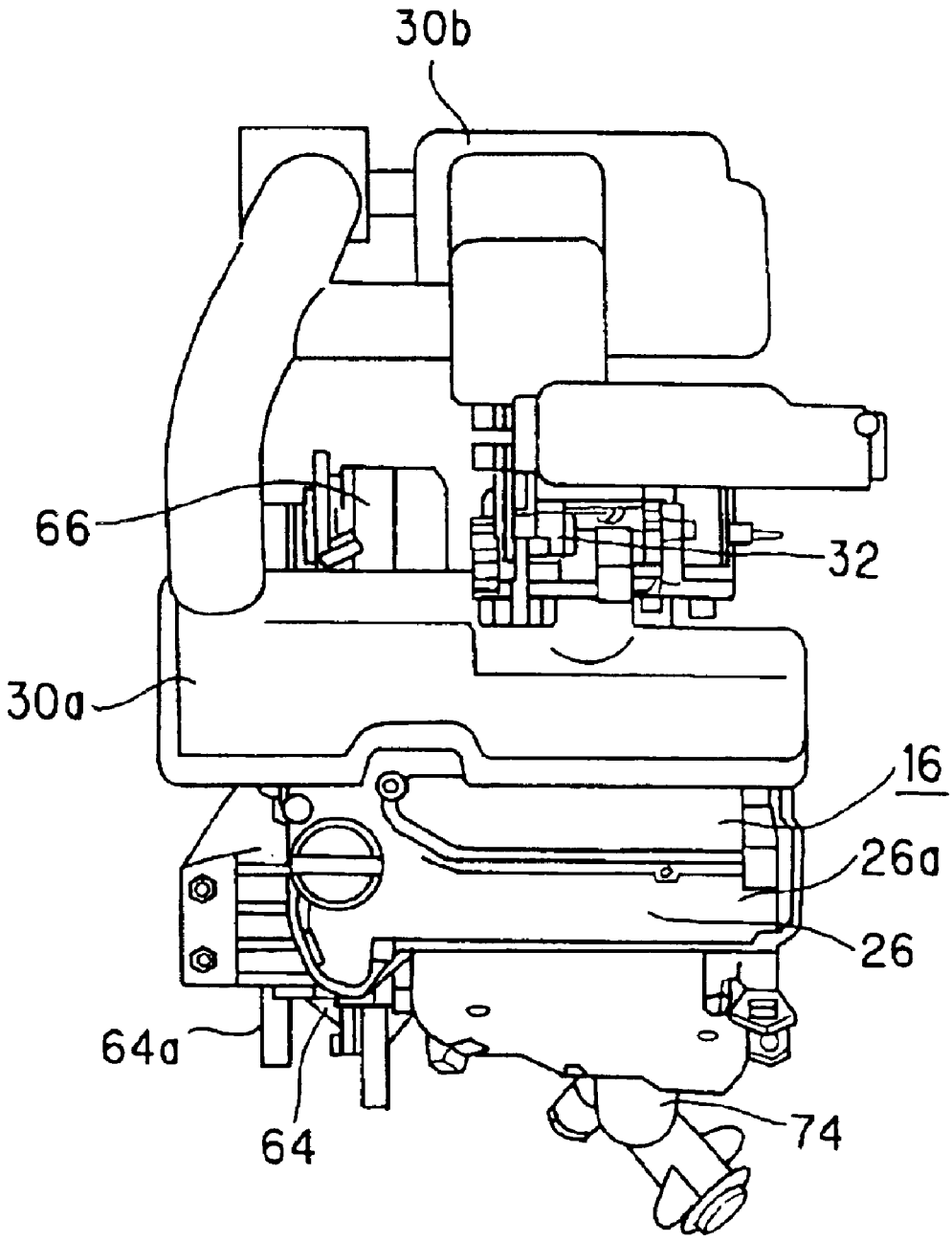
FIG. 8 is a plan view showing a four-cycle engine.

FIG. 1 is an enlarged illustrative side view showing the front part of a snowmobile equipped with a four-cycle engine which is applied to the first embodiment of the present invention; FIG. 2 is an illustrative side view showing the overall configuration of the same snowmobile; FIG. 3 is an illustrative plan view showing the overall configuration of the same snowmobile; FIG. 4 is an enlarged illustrative view showing the detail of FIG. 3; FIG. 5 is an illustrative front view showing a snowmobile; FIGS. 6A and 6B are illustrative layout views of a battery, cut along a VI—VI plane in FIG. 4; FIGS. 7A and 7B are external side view and front view, showing the four-cycle engine; and FIG. 8 is a plan view showing a four-cycle engine.

As shown in FIGS. 1 to 4, the snowmobile of the embodiment is one which includes a three-cylinder (one example of a multi-cylinder) four-cycle engine 16 in an engine hood 14 in front of a rider's seat 12 or located in the front body, designated at 10*f* of a body 10. The engine hood 14 has a headlight 20 formed on the front side of the topmost part thereof (a projected portion 18 that projects on the top in this embodiment). The four-cycle engine 16 is mounted in such a manner that its crankshaft 22 is arranged along the body width direction while the central axis 24*c* of a cylinder block 24 is tilted rearward by an angle θ with respect to the vertical direction 10*c* of the body, forming a rear tilted engine.

An alternator 66 as a generator is provided for the four-cycle engine 16 while heat exchangers 17 through which the cooling water of the engine 16 is cooled by heat exchange with external air and snow are arranged, one (17*a*) in a front crawler house 52 and one (17*b*) in a rear crawler house 92. Alternator 66 is positioned between the four-cycle engine 16 and the front heat exchanger 17*a* and fixed to the engine 16 by means of a bracket or the like.

Further, in the four-cycle engine 16, a pulley 22*a* is provided at the crankshaft 22 end opposite to the mounted side of a clutch mechanism 82 of engine 16, and a timing belt 68 is wound between this pulley 22*a* and a driven pulley 66*a* for alternator drive so that alternator 66 is driven by the rotation of crankshaft 22.

An intake system 34 of engine 16 includes an air cleaner box 30 and throttle body 32 connected to intake ports 28 at the rear of a cylinder head 26 of the engine 16, and a front part 30*a* of air cleaner box 30 and the upper part of throttle body 32 of intake system 34 are accommodated in the rear space of headlight 20 inside the projected portion 18 at the top of the engine hood 14. An exhaust system 38 is extended from exhaust ports 36 at the front of cylinder head 26 so that exhaust is led forwards to the front of cylinder block 24.

Now, the configuration of this snowmobile will be described in further detail.

As shown in FIGS. 2 and 3, the snowmobile according to the embodiment has a pair of steerable ski-runners 40, left and right, at the bottom of front body 10*f* of vehicle body 10 which extends in the front-to-rear direction. These steerable ski-runners 40 are rotatably mounted so that they turn left and right. Arranged under the rear body, designated at 10*r*, on which the aforementioned rider's seat 12 is mounted, is a crawler 44 which circulates a track belt 42. This crawler 44 comprises a drive wheel 44*a* arranged at the front end of rear body 10*r*, an idle wheel 44*b* arranged at its rear end and a multiple number of middle wheels 44*c*, a suspension mechanism 44*d* for supporting and cushioning these items and track belt 42 wound around these wheels and driven circulatively.

The body 10 has a monocoque frame configuration. The front body (engine mount frame) 10*f* with four-cycle engine 16 mounted thereon is so shaped that it gradually becomes narrower, when viewed from its top, having, overall, a ship's bottom-like configuration with a top opening 10*f*1, which is enclosed by engine hood 14, thereby forming an engine room 46 therein. The boundary edge of the top opening 10*f*1 is formed by a lightly waving curve.

In front body 10*f*, as mainly shown in FIG. 2, the inner bottom surface of engine room 46 is formed so that its center (to be called the principal portion) 48 with respect to the body width and with respect to the front-to-rear direction becomes the lowest. An engine oil pan 16*a* is positioned in the adjoining area of the lowest point of the principal portion 48 and over principal portion 48 while four-cycle engine 16 is fixed and unexpended at its front lower point in a floating manner. A lengthwise center of engine 16 is depicted by line 16*c* (see FIG. 4).

The center of the inner bottom of engine room 46 with respect to the body width is gently inclined upward forming a front portion 48*a* of the principal portion 48. The bottom of engine room 46 is raised upwards, from the positions on both the left and right sides of principal portion 48 to the front (or depressed downwards in view of body front 10*f*), forming ski-runner housings 50, so that ski runners 40 will not interfere with the body when steerable ski-runners 40 are rotated or make cushioning actions. The front part 50*a* of each ski-runner house 50 is depressed more upwards than the vicinity of principal portion 48 so as to accommodate the suspension mechanism and steering mechanism 40*a* of each ski-runner 40 (see FIG. 4). The bottom surface on the rear side of principal portion 48 is projected more upwards than principal portion 48, forming crawler house 52 for accommodating the front part (near drive wheels 44*a*) of the crawler 44. Crawler house 52 accommodates drive wheels 44*a* and thereabout of crawler 44, and the rear part of crawler house 52 is connected to rear crawler house 92, located in rear body 10*r*, which accommodates practically whole part of crawler 44, including idle wheels 44*b*, middle wheels 44*c* and suspension mechanism 44*d*. Front heat exchanger 17*a* is disposed on the front inclined portion of crawler house 52 while rear heat exchanger 17*b*, which extends in the front-to-rear direction up to the rear end of crawler 44 (see FIG. 2), is provided on the ceiling of rear crawler house 92.

A steering shaft (also called steering post) 54 is provided and rotationally mounted in front of seat 12 and in the rear part of engine hood 14 so as to be somewhat inclined rearwards with its upper part projected penetrating through the hood. A pair of steering handlebars 56 for steering control are attached at the top end of this steering shaft 54. The bottom end of steering shaft 54 is rotatably supported by the body at a position adjoining the crawler house 52 and is coupled with an unillustrated linkage so that the steering force is transmitted to steering mechanism 40*a* for turning ski-runners 40 to the left and right for maneuvering.

The rear tilted four-cycle engine 16 mounted in engine room 46 in engine hood 14 has, in its lower part, oil pan 16*a* at the bottom of crankcase 58 as shown in FIGS. 1 to 8. An oil strainer 16*b* is arranged at the oil sectioning port in oil pan 16*a*. Pistons 24*a* move up and down in cylinder block 24 above the engine crankcase 58 and the reciprocating movement of pistons 24*a* is converted into the rotational movement of crankshaft 22 via connecting rods 58*a*. Cylinder head 26 arranged on the top of cylinder block 24 has intake and exhaust valves 60*a* and 62*b* for opening and shutting corresponding intake and exhaust ports 28 and 36 which are connected to the combustion chambers of cylinder block 24, and their valve gear mechanisms 60*b* and 62*a*. In this way, the engine of this embodiment has a double-overhead cam type four-cycle engine configuration.

A water pump 64 is arranged above crankcase 58 and in front of engine cylinder block 24 while an alternator 66 is disposed behind the engine cylinder block 24. Driven pulleys 64*a* and 66*a* are respectively attached. A timing belt 68 is wound around these pulleys and drive pulley 22*a* attached to crankshaft 22 outside crankcase 58 so that the water pump and alternator can be driven by the crankshaft.

The water pump 64, alternator 66 and crankshaft 22 are positioned in an inverted triangular manner when viewed from their side, so that water pump 64 and alternator 66 are positioned in front and at the rear, in an approximately axisymmetric manner with respect to engine cylinder axis 24*c*. Further, the upper path of timing belt 68 is laid out so as to be approximately parallel to the abutment between cylinder head 26 and cylinder block 24.

Alternator 66 is positioned between cylinder block 24 and oil pan 16*a* of four-cycle engine 16 and over oil pan 16*a*, as stated above. Alternator 66 is located under intake pipe (intake manifold) 32*a* connected between throttle body 32 and intake ports 28 in the intake system. Alternator 66 is located at the side of steering shaft 54 when viewed from the front side of the vehicle (see FIGS. 4 and 5).

An approximately cylindrical oil filter 70 is arranged in front of crankcase 58 so as to stand with its center axis oriented upwards and frontwards. The top position of this oil filter 70 approximately corresponds to the lower end of water pump 64, when viewed from the side.

Projected portion 18 that projects upwards is formed on the topmost portion of the engine hood 14. A single headlight 20 unit is arranged on the front side of this projected portion 18 while an instrument panel 72 for indicating the vehicle's condition is disposed on the rear side of projected portion 18. At least part of intake system 34 is accommodated in a space enclosed between headlight 20 and instrument panel 72 of projected portion 18. A fairing 19 opening rearwards for protecting the rider from the wind is formed so as to cover the projected portion 18 and be wider than the width of steering handlebars 56 and is disposed over engine hood 14.

In intake system 34 of the embodiment, air cleaner box 30 is composed of two parts (front box 30*a* and rear box 30*b*) arranged in front of and behind throttle body 32, the upper part of throttle 32 and front box 30*a* lap the projected portion 18 when viewed from the side. Front box 30*a* is located over cylinder head 26 (over cylinder head cover 26*a*) lapping engine 16 when viewed from the top. Rear box 30*b* is disposed in a space over a drive sprocket shaft 84.

In this intake system 34, intake air flows from rear box 30*b* to front box 30*a* so that air-fuel mixture flows frontwards and downwards from throttle body 32 to intake pipe 32*a* and intake ports 28 of engine 16.

The exhaust system 38 is comprised, as shown in FIGS. 1, 4 and 5, of an exhaust manifold 74 connected to exhaust ports 36 at the front of cylinder head 26 and an exhaust muffler 78 disposed in front of engine 16 and connected to the exit side of exhaust manifold 74 via an exhaust pipe 76. All these exhaust elements are laid out inside engine room 46 and covered by engine hood 14. In this embodiment, the muffler 78 is set over the front portion 48*a* of the principal portion. An exhaust lead pipe 80 from muffler 78 is provided penetrating through the bottom of body 10 with its opening 80*a* located at the center (indicated by SC) with respect to the body width at the bottom of body 10 so that exhaust from engine 16 is discharged through the opening 80*a* to the outside of the vehicle or towards the ground.

Muffler 78 is located below the engine cylinder block 24 so that exhaust pipe 76 connected to exhaust manifold 74 is extended frontwards and downwards to muffler 78. Exhaust manifold 74 has multiple entrance apertures connected to multiple (three) exhaust ports 36 (one for each of three cylinders in this embodiment) of four-cycle engine 16 and has an integrated exit connected to exhaust pipe 76. This integrated part lies frontwards and downwards.

The muffler 78 is formed of an overally cylindrical shape with its cylinder axis 78*a* directed along the body width. Connected to one side of the muffler with respect to the body width (on the left side of the vehicle in this embodiment) is the exit side of exhaust pipe 76 which is curved in an approximate C-shape. Thus, exhaust from four-cycle engine 16 is led through pipe 76 into muffler 78. The muffler 78 is off-centered to the other side with respect to the vehicle body width (to the right side of the body in this embodiment), so that exhaust pipe 76 can be laid out so as to be kept apart from the inner wall of engine room 46.

In engine hood 14, four-cycle engine 16 is arranged so that the lengthwise center, designated at 16C, of crankshaft 22 is off-centered to one side with respect to the center SC of the body width (see FIG. 4). Further, in engine hood 14, clutch mechanism 82 is arranged on one side (on the left side of the body in this embodiment) of four-cycle engine 16 while a battery 86 is disposed on the other side with respect to the body width. Clutch mechanism 82 is comprised of a drive clutch pulley 82*a* fitted on the output end of the engine crankshaft, a driven clutch pulley 82*b* fitted on a crawler drive sprocket shaft 84 on the side opposite to a sprocket 84*a* and a V-belt 82*c* having a V-shaped section and also serving as a V-belt speed change gear. A linkage gear 85 which meshes an unillustrated starter motor and transmits the driving force to crankshaft 22 is disposed adjacent to the four-cycle engine and at the side of drive clutch pulley 82*a* of clutch mechanism 82.

It is preferred that electrical equipment 90 such as ECU, CDI units and the like is attached to the buttery holder, designated at 88, for accommodating and fastening battery 86 without its rattling. As shown in FIGS. 4 and 6A and 6B, battery holder 88 is formed of a metal mount having a section of L-shape. As shown in FIG. 6A, electrical equipment 90 and battery 86 may be fitted back to back or electrical equipment 90 may be fitted above battery 86 as shown in FIG. 6B.

As described heretofore, according to this embodiment, since alternator 66 is arranged between the engine and heat exchanger (front portion 17*a*), no snow or rain will strike the alternator if the flow of air is conducted into engine hood 14 (into engine room 46) during travel. Accordingly, it is possible to prevent the possibility of inconveniences arising due to exposure of alternator 66 to water from snow and rain.

Since alternator 66 is driven together with water pump 64 by common timing belt 68, the number of driving parts can be reduced.

In the four-cycle engine 16, alternator 66 is arranged under the intake manifold (corresponding to intake pipe 32*a* connected to throttle body 32). Accordingly, alternator 66 is allocated to a confined space under the intake manifold, so as to avoid its interference within take system 34. Further, if snow and water, entering engine room 46 together with a flow of air during travel, threatens to come around and over engine 16, intake system 34 and intake pipe 32*a* function as a shield, to thereby prevent snow and the like from wetting alternator 66, in a reliable manner.

Since the steering device including steering shaft 54 with handlebars on top is arranged penetrating through engine room 46 while the alternator is arranged at the side of the steering post when viewed from the front of the vehicle, it is possible to avoid interference between steering shaft 54 and alternator 66 when four-cycle engine 16 needs to be arranged as far rearwards as possible within engine hood 14. Therefore, it is possible to dispose engine 16 at a position most rearwards in engine room 46, to thereby make the center of gravity of the engine close to that of the vehicle body.

Since four-cycle engine 16 is tilted rearwards so that part of the intake system over engine 16 can be accommodated on the rear side of headlight 20 inside the topmost portion (projected portion 18) of engine hood 14, it is possible to avoid its interference with engine hood 14 and headlight 20 and yet markedly reduce the full height of the engine compared to the upright engine configuration. Further, the rear tilt arrangement of four-cycle engine 16 in engine hood 14 of the front body makes the center of gravity of engine 16 close to the center of the body and also lowers the center of gravity of the snowmobile because of the lower positioning of cylinder head 26, whereby it is possible to improve the maneuverability and travelling performance of the snowmobile. Further, the rear tilt arrangement of engine 16 creates a more space in front of the engine so that exhaust pipes and other components can be laid out with more flexibility, hence it is possible to further reduce the height of engine hood 14. Since, if intake system 34 connected to the rear part of the engine is arranged over engine 16 the elements of the intake system can be arranged behind headlight 20 in the topmost portion of engine hood 14, it is possible to improve the space efficiency without the need of modification or reconstruction such as increasing the height of the engine hood.

In the above arrangement, upward projected portion 18 is formed at the topmost portion of engine hood 14 and headlight 20 and instrument panel 72 for indicating the vehicle's condition are arranged at the front and rear of the projected portion 18, respectively, so that it is possible to insert at least part of intake system 34 into the space between headlight 20 and instrument panel 72 inside the projected portion 18. In this way, it is possible to make use of the empty space behind headlight 20 at the topmost portion of engine hood 14, in which headlight 20 and instrument panel 72 are disposed, and to interpose part of the intake system in a space efficient manner, whereby it is possible to make the shape of engine hood 14 short in its height.

Exhaust system 38 is constructed of exhaust manifold 74 connected to exhaust ports 36 at the front of cylinder head 26 and exhaust muffler 78 arranged in front of the engine and connected to the exit side of exhaust manifold 74 by exhaust pipe 76, all being accommodated inside engine hood 14 while opening 80*a* of exhaust lead pipe 80 from the muffler 78 is arranged in the body bottom at the center with respect to the body width so that exhaust can be discharged from the opening 80*a* to the outside of the vehicle. Accordingly, exhaust can be discharged from the body bottom at the center with respect to the body width. Since exhaust noise can be dispersed from the body bottom to both sides and since the exhaust opening is located in the front body, the noise arises at a position away from the rider so that the exhaust noise will not be very harsh to the rider while travelling. Further, since the opening is located at the center of the body width, the exhaust noise during travelling will scatter equally to both sides, and since the opening is directed downwards, extra muffling effects from the snow surface and from the snow scattered by the steering ski-runners can be expected.

Further, since muffler 78 is located below engine cylinder block 24, and exhaust pipe 76, connected to exhaust manifold 74, is extended frontwards and downwards up to muffler 78, the layout of exhaust pipe 76 from engine 16 up to muffler 78 is inclined downward as it goes frontwards. That is, this arrangement compliments the engine hood 14 configuration which lowers as it goes frontward to improve the aerodynamic performance.

Since muffler 78, formed of an approximately cylindrical shape, is arranged with its cylindrical axis set along the body width direction while exhaust from engine 16 is led into muffler 78 by way of exhaust pipe 76 that is connected to one side of the muffler with respect to the body width, it is possible to mount muffler 78 within engine hood 14 without the necessity of taking a large space in the longitudinal direction.

Further, four-cycle engine 16 is mounted in engine hood 14 with the lengthwise center of the crankshaft off-centered to one side with respect to the body width while battery 86 is put on the other side, so as to improve the space efficiency.

Since clutch mechanism 82 is arranged at one side of engine 16 and battery 86 is arranged at the other side in engine hood 14, the weight balance with respect to the width direction can be easily adjusted.

Since electrical equipment is attached to battery holder 88 for holding battery 86, it is possible to adjust the weight balance in a more exact manner, by attaching electrical equipment 90 such as an ECU, CDI unit to battery holder 88. Further, since electrical equipment can be laid out next to engine 16, it is possible to shorten their lead wires from engine 16, hence simplify the routing of wires.

Figure 9:
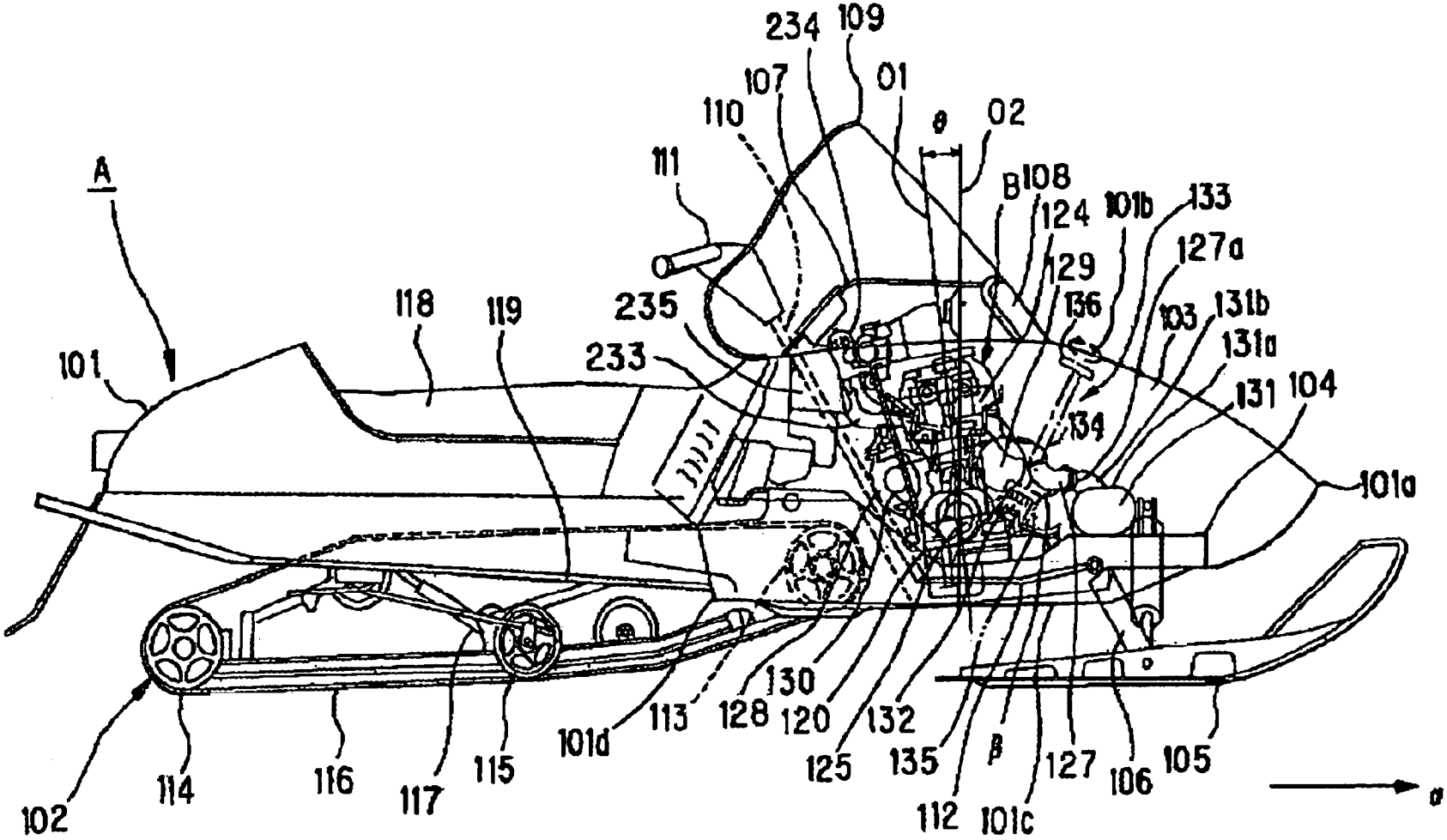
FIG. 9 is a detailed side view showing a snowmobile equipped with a four-cycle engine which is applied to the second embodiment of the present invention.
Figure 10:
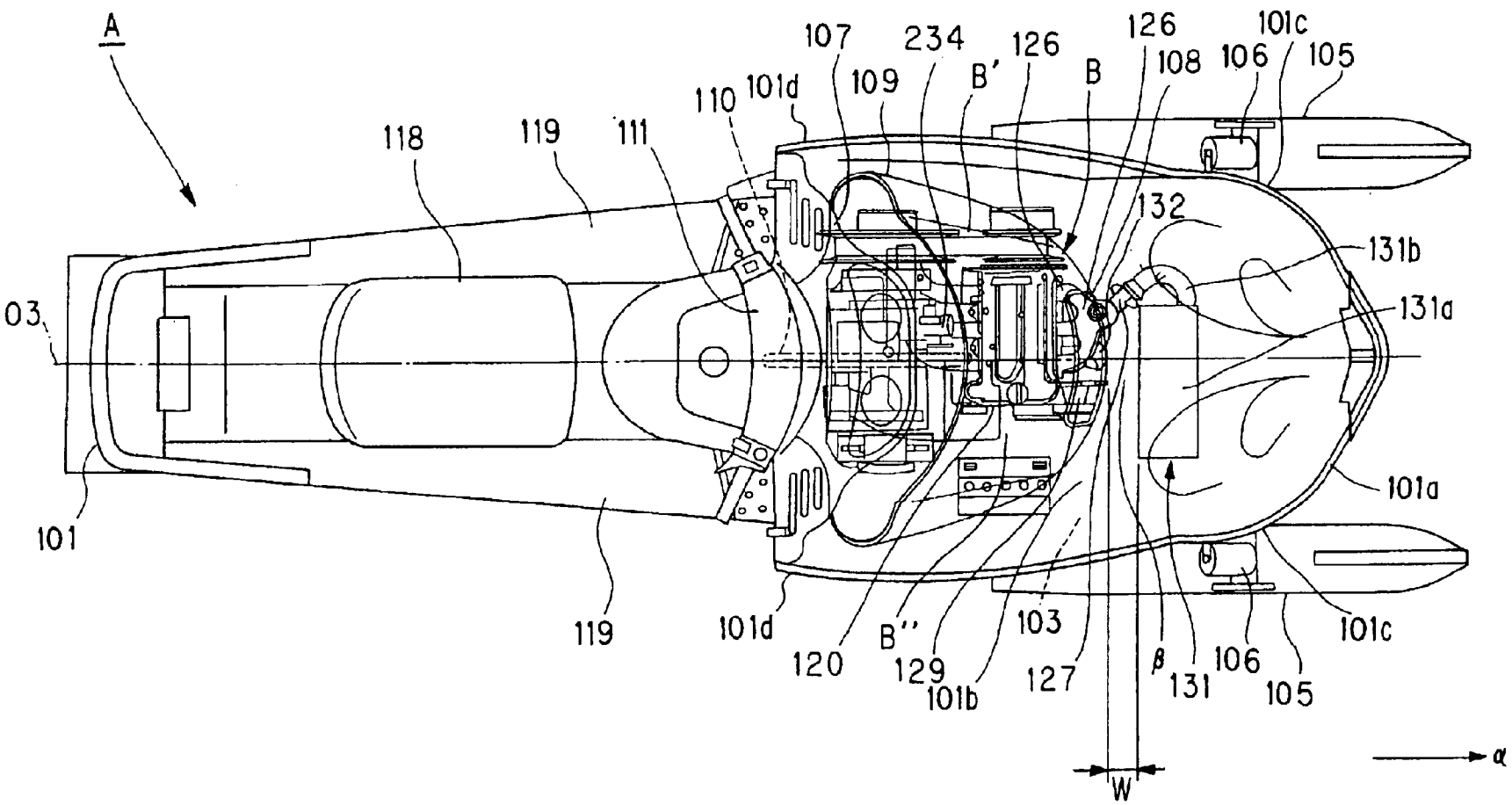
FIG. 10 is a plan view showing the snowmobile.
Figure 11:
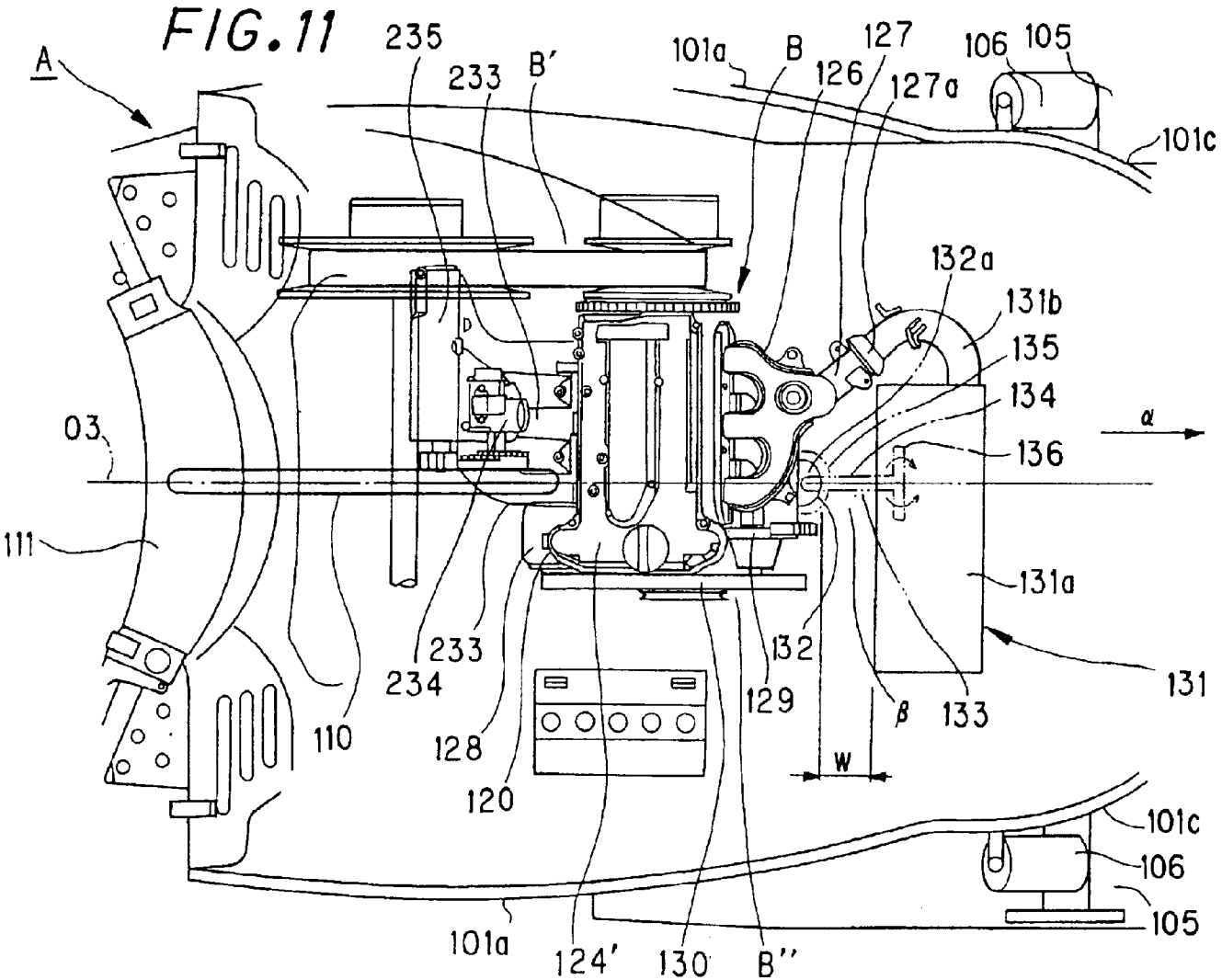
FIG. 11 is an enlarged detailed view showing the front part of the body of the snowmobile.
Figure 12:
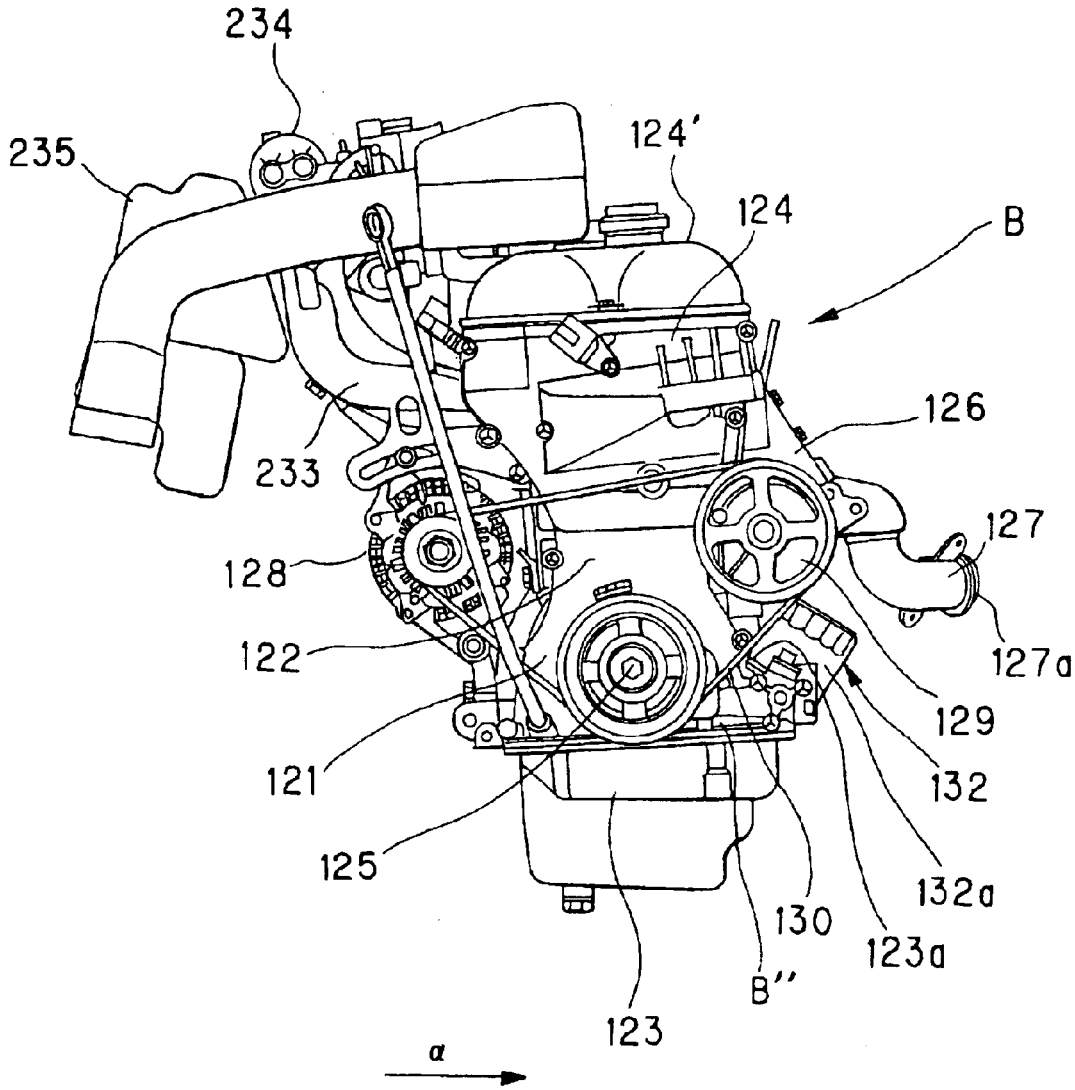
FIG. 12 is a side view showing the detail of a four-cycle engine mounted on the snowmobile shown in FIG. 9; and, FIG. 13 is a front view showing the four-cycle engine.
Figure 13:
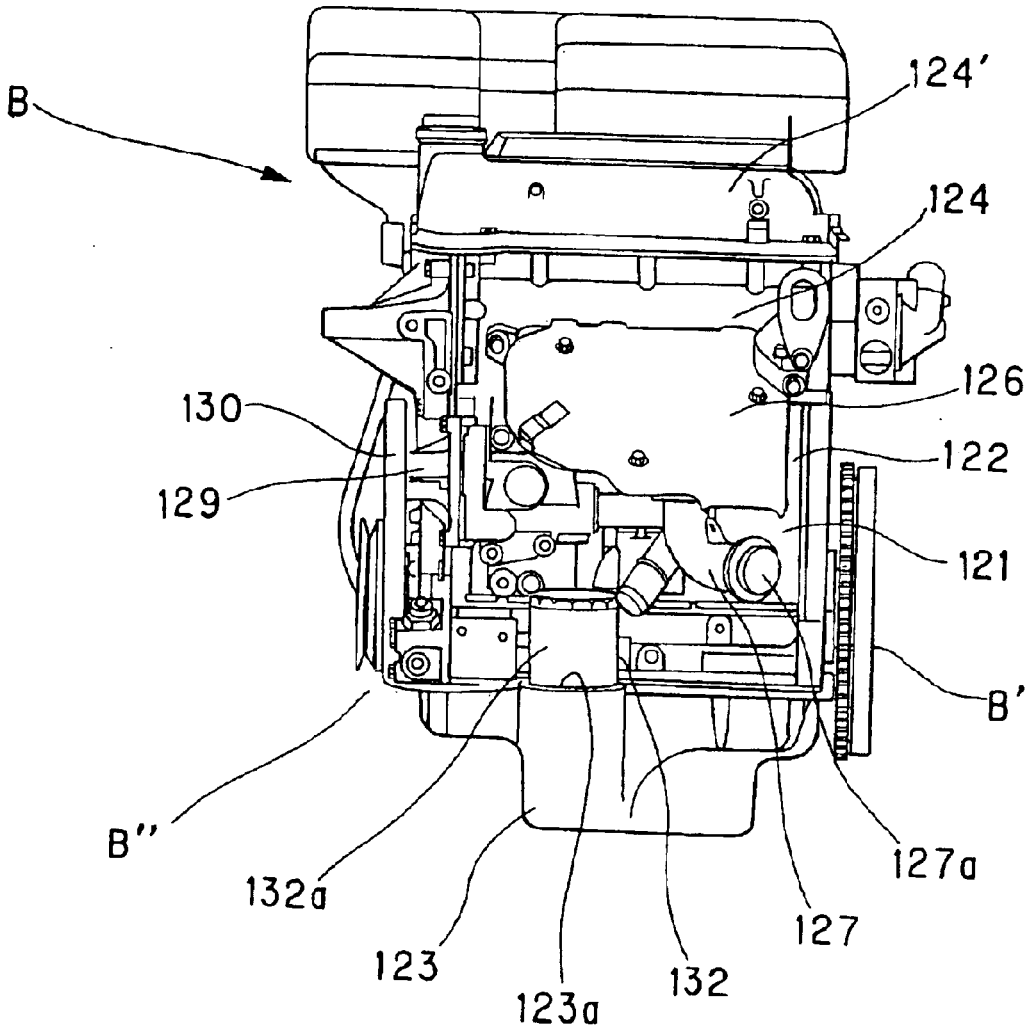

Next, the second embodiment of the present invention will be described with reference to the drawings. FIG. 9 is a side view showing the overall configuration of a snowmobile; FIG. 10 is a plan view showing that snowmobile; FIG. 11 is an enlarged detailed view showing the front part of the body of the snowmobile; FIG. 12 is a side view showing the detail of a four-cycle engine mounted on the snowmobile shown in FIG. 9; and, FIG. 13 is a front view showing that four-cycle engine.

A snowmobile A as a small snow vehicle is constructed of a body 101 of a monocoque configuration having a water-cooled snowmobile four-cycle engine (to be referred to simply as an engine hereinbelow) B at the front part 101*a* thereof and a crawler 102 arranged in the rear half of the body 101. The detailed structure of each component is as follows.

Formed in front part 101*a* of body 101 is an engine room 103 with an engine hood 101*b* attached in an openable and closable manner on the top face thereof. In this engine room 103, an engine mount portion 104 on which the engine B is mounted is formed.

A pair of steerable ski-runners 105 and 105 which can be turned left and right are supported by front suspensions 106 and 106, under the engine mount portion 104.

Further, front suspension housings 101*c* and 101*c* for accommodating the upper parts of the front suspensions 106 and 106 are integrally formed at both sides of front part 101*a* of body 101.

An instrument panel 107 including a speedometer/tachometer and other instruments is arranged behind the rear edge area of engine hood 101*b* or on the top face of front part 101*a* of body 101, and stepped some degrees higher than the rear edge of engine hood 101*b* while a headlight 108 is disposed at the stepped portion.

Designated at 109 is a windshield which is provided so as to be upright with its upper rim tilted to the rear to some degree so that it encloses instrument panel 107 along its front boundary from the front and to each side.

A steering post 110 is arranged behind the engine B so that it stands with its top end tilted rearwards to some degree. Steering handlebars 111 for controlling the steerable ski-runners 105 and 105 are attached at the top end of steering post 110.

The lower end part of steering post 110 and each of steerable ski-runners 105, 105 are linked by a steering rod 112, which is extended forwards, below the engine body (to be also referred to simply as body) 120, which will be detailed later, or more specifically, along the side of oil pan 123. By this arrangement, steerable ski-runners 105 and 105 can be steered through steering post 110 and steering rods 112 when steering handlebars 111 are controlled.

From the front side to the rear part of the middle part of body 101, a track housing 101*d* for accommodating the front part of an aftermentioned crawler 102 is integrally formed.

Crawler 102 comprises a drive wheel 113 arranged at the front side of the middle part of body 101, an idle wheel 114 arranged in the rear of the drive wheel 113 and a middle wheel 115 arranged between the drive and idle wheels, a track belt 116 wound around these wheels and a suspension mechanism 117 interposed between body 101 and the proximity of the middle wheel 115.

A saddle type seat 118 is arranged on the top of the middle part of body 101 with steps 119 and 119 projected at a lower position of the seat 118 to both sides of the body.

Next, the configuration of engine B will be described in detail with reference to FIGS. 11 to 13 as well as to FIGS. 9 and 10.

Body 120 of engine B is comprised of a cylinder block 122 having three cylinders aligned in the body width direction on top of a crankcase 121 and an oil pan 123 under the crankcase 121, and is disposed close to the front side of steering post 110. Here, reference numerals 124 and 124' designate a cylinder head on the top of cylinder block 122 and a cylinder head cover, respectively.

The cylinder block 122 is tilted rearwards in opposition to the travelling direction a of body 101. In other words, the cylinder block is set so that the axis O1 of cylinder block 122 is inclined to the rear (tilted rearward by an angle θ) with respect to a vertical line 02 passing through a crankshaft 125 which is substantially parallel to the body width direction.

An exhaust manifold 126 is projected from the front side of cylinder head 124. In exhaust manifold 126, a connecting pipe 127 is extracted from a position off-centered to one side (the drive clutch B' side) with respect to the body width direction which is perpendicular to the vehicle's direction of travel α, or from a position to one side of the body center O3.

Connecting pipe 127 is formed in an approximate L-shape, when viewed from the body side, with its connecting opening 127*a* to an aftermentioned muffler 131 directed to the drive clutch B' side.

A water pump 129 is disposed in front of cylinder block 122, below exhaust manifold 126 and on the other side with respect to the body width direction or on the side B" opposite to the drive clutch B' (to be referred to as the clutch opposite side B" herein below), at a position on the opposite side of alternator 128 with cylinder block 122 in between.

Water pump 129 is connected together with the alternator 128 by a common drive belt 130 and driven therethrough by the driving force from crank shaft 125. Driving of water pump 129 pumps and supplies cooling water to an unillustrated water jacket formed inside engine B to cool it.

Muffler 131 is composed of a muffler body 131*a* having an oval cross-section and arranged with its length set along the body width direction and a connecting pipe 131*b* which is to be joined to the connecting pipe 127 and is extracted from the muffler body, specifically, from the side end face on the drive clutch B' side, curved in an approximate U-shape, viewed from the top of the vehicle. Thus, connecting pipe 131*b* is also off-centered to the drive clutch B' side or arranged at a position to one side of the body center O3.

This muffler 131 is arranged on the engine mount portion 104 and positioned at almost the same height as the oil filter 132, on the front side of engine body 120, being kept a necessary distance W apart from an aftermentioned oil filter 132 located in front of engine body 120.

The above arrangement of muffler 131 and formation of connecting pipe 127 with its connecting opening 127*a* directed to the drive clutch B' side, affords the creation of a work space β, in front of engine body 120, for replacement work of the aftermentioned oil filter 132.

In the present embodiment, work space β is assumed to be large enough for an aftermentioned filter replacement tool 133 to be inserted, but can be defined as appropriate without being limited to this.

A filter attachment port 123*a* for allowing attachment and removal of oil filter 132 is formed so as to be forward tilt opening in the vehicle's direction of travel α, at the center on the front side of oil pan 123, or on the center O3 of body 101, in the top view of the vehicle.

Oil filter 132 is of a full-flow type which holds a filter cartridge (not shown) in an approximately cylindrical, bottom-opening case 132*a* and can be screw fitted into the filter attachment port 123*a*.

Accordingly, oil filter 132 attached to filter attachment port 123*a* is tilted forwards in the vehicle's direction of travel a and located below water pump 129, at a position closer to the drive clutch B' side than water pump 129 is.

The amount of inclination of oil filter 132 is designated in the present embodiment so that, as shown in FIG. 12, the oil filter 132 will not interfere with water pump 129 which is arranged between the oil filter 132 and the exhaust manifold 126. In other words, the angle of inclination is determined appropriately so that oil filter 132 will not interfere with water pump 129 when the oil filter is attached to or removed from filter attachment port 123*a*.

In the above arrangement, when oil filter 132 has been attached to the filter attachment portion 123*a*, the approximately cylindrical case 132*a* is set with its upper side projected, to some degree, more forwards than water pump 129.

To describe further, oil filter 132 is located in the space enclosed, in the side view, by the crankshaft 125 of engine body 120, exhaust manifold 126 and steering rod 112.

Replacement of the above oil filter 132 is performed in the following manner.

In the present embodiment, oil filter 132 is replaced by using a filter replacement tool 133 shown in FIGS. 9 and 11.

Filter replacement tool 133 is comprised of a long shank 134 having a socket 135 at the distal end thereof for holding the approximately cylindrical case 132*a* of oil filter 132 so as not to relatively rotate and a shaft laterally attached to the rear end of the shank, forming a handle bar 136.

This filter replacement tool 133 is inserted into the work space β created in front of engine body 120 so as to fit socket 135 on approximately cylindrical case 132*a* of oil filter 132.

After fitting, oil filter 132 is turned in one direction by filter replacement tool 133 so that it is removed.

Mounting and fixture of oil filter 132 to filter attachment port 132*a* is performed by previously fitting oil filter 132 into socket 135, inserting it into the work space β and screwing it into filter attachment portion 132*a*.

As stated above, in the present embodiment, since an adequate enough work space β, typified by the breadth W, to afford insertion of filter replacement tool 133 for replacement work of oil filter 132 is created, the replacement can be easily done.

Other than above, an intake manifold 233 is projectively formed to the rear from the rear part of the cylinder head 124.

Intake manifold 233 is arranged at a level higher than cylinder head 124, so that a downward current of air is supplied to the unillustrated intake ports by 'downdraft'. An air cleaner 235 and throttle body 234 are connected in this order to the intake manifold.

Part of the intake system including the throttle body 234 is arranged at a level higher than cylinder head 124 and laid out in the space over engine body 120, under instrument panel 107 and behind a headlight 108.

It is noted that the present invention should not be limited to the embodiment described above, the following variation is possible.

In the above embodiment, an example in which the oil filter is tilted so as to avoid interference with the water pump located above it has been described. However, if, in some embodiment, the exhaust manifold is located above and close to the oil filter, the oil filter may be tilted so as to avoid interference with the exhaust manifold.

As has been described above, according to the present invention, since the front-to-rear size of the whole engine to be mounted to a snowmobile is reduced by carefully configuring a layout of the auxiliaries such as an alternator etc., it is possible for the engine to avoid interference with the steering post and other components. It is also possible to make the center of gravity of the vehicle at a position close to the body center by arranging the engine close to the body center, so that the maneuverability can be improved. It is further possible to prevent the auxiliaries from being influenced by snow sifting into the engine room.

Further, according to the present invention, since the approximately cylindrical oil filter is arranged under the exhaust manifold so as to be tilted forwards in the vehicle's direction of travel, replacement of the oil filter will never be obstructed by the exhaust manifold. Further, it is not necessary to remove any parts around the oil filter when the oil filter is replaced.

Since the oil filter is arranged in front of the engine body and hence it is positioned in proximity to the engine body and tilted forwards in the vehicle's direction of travel, it is possible to achieve a layout of a four-cycle engine as compact as that when a two-cycle engine is mounted.

In addition to the above common effects, since steering rods extended forwards from a lower position of the engine body are coupled to the lower end of the steering post arranged in the rear of the engine body while the filter attachment port is positioned in the space enclosed, in the side view, by the crankshaft of the engine body, exhaust manifold and steering rods, it is possible to achieve a further compact layout and yet permit easy oil filter replacement.

Since the water pump is arranged between the oil filter and exhaust manifold and the oil filter is tilted so as to avoid its interface with the water pump, replacement work of the oil filter will never be obstructed even in a configuration where the water pump is laid out over the oil filter.

Finally, since work space is created in front of the engine body, replacement of oil filters can be made in a markedly simple manner.

What is claimed is:

1. An arrangement and structure of auxiliaries in a four-cycle snowmobile engine mounted in an engine room located on a front body and in front of a seat, the four-cycle engine comprising:

an engine body having a cylinder block on top of a crankcase;

an exhaust manifold arranged on a front side of a cylinder head on top of the cylinder block;

an oil pan under the crankcase;

an oil filter having an approximately cylindrical shape, the oil filter being positioned above the oil pan, in front of the cylinder block under the exhaust manifold, and tilted forwards in a direction of travel so as to avoid interference with the exhaust manifold.

2. The arrangement and structure of auxiliaries in a four-cycle snowmobile engine according to claim 1, wherein:

steering rods extend forwards from a lower position of the engine body and are coupled to a lower end of a steering post arranged in a rear of the engine body;

the oil filter is positioned in a space enclosed, in a side view of the snowmobile body, by a crankshaft of the engine body, the exhaust manifold, and the steering rods.

3. The arrangement and structure of auxiliaries in a four-cycle snowmobile engine according to claim 1, wherein a water pump is arranged between the oil filter and the exhaust manifold and the oil filter is tilted so as to avoid its interface with the water pump.

4. The arrangement and structure of auxiliaries in a four-cycle snowmobile engine according to claim 1, wherein a muffler is disposed in front of and a distance apart from the engine body and wherein a connecting pipe that joins the muffler and the exhaust manifold is off-centered to one side from a center of the engine body with respect to a body width direction so as to create a work space for oil filter replacement.

5. The arrangement and structure of auxiliaries in a four-cycle snowmobile engine according to claim 1, wherein the engine body is tilted rearwards.

6. A four-cycle engine for mounting in an engine room of a body of a snowmobile, the engine comprising:

a crankcase having a crankshaft arranged along a body width direction of the snowmobile;

a cylinder block having a central axis which is tilted rearward with respect to a vertical direction of the body of the snowmobile;

an intake system including an intake manifold situated behind the central axis of the cylinder block;

an alternator driven by rotation of the crankshaft, the alternator being disposed behind the cylinder block and beneath the intake system.

7. The engine of claim 6, wherein the alternator is situated relative to the intake system so that the intake system including the intake manifold prevents precipitation flowing into the engine room from wetting the alternator.

8. The engine of claim 6, further comprising a water pump arranged above the crankcase and in front of the cylinder block.

9. The engine of claim 8, wherein the water pump, the alternator, and the crankshaft are in an inverted triangular manner when viewed from a side.

10. The engine of claim 8, wherein the water pump and alternator are axisymmetric with respect to an engine cylinder axis.

11. The engine of claim 6, wherein the alternator is located at a side of a steering shaft of the snowmobile when viewed from a front of the snowmobile.

12. The engine of claim 6, wherein further comprising an oil pan situated at a bottom of the crankcase.

13. The engine of claim 12, wherein the alternator is situated vertically between the oil pan and the intake system.

14. The engine of claim 6, wherein the alternator has an alternator pulley and the crankshaft has a crankshaft pulley, and wherein a belt is wound around an alternator pulley and a crankshaft pulley so that the alternator is driven by the crankshaft.

15. The engine of claim 6, wherein the alternator is situated between the engine and a heat exchanger.

16. The engine of claim 15, wherein the heat exchanger is behind the engine in a direction of travel of the snowmobile.

17. The engine according to claim 6, wherein the alternator is disposed between the engine and a heat exchanger;

a timing belt is wound between a pulley fitted on the crankshaft on a side opposite to that where an engine clutch mechanism is disposed and a pulley for driving the alternator, so that the alternator is driven by the rotation of the crankshaft.

18. A four-cycle engine for mounting in an engine room of a body of a snowmobile, the engine comprising:

a crankcase having a crankshaft arranged along a body width direction of the snowmobile;

a cylinder block having a central axis which is tilted rearward with respect to a vertical direction of the body of the snowmobile;

an intake system including an intake manifold situated behind the central axis of the cylinder block;

an alternator driven by rotation of the crankshaft, the alternator being disposed behind the cylinder block and beneath the intake system;

an oil filter situated in front of the crankcase, the oil filter having an oil filter central axis which is oriented upwards and frontwards.

19. The engine of claim 18, further comprising a water pump situated above the crankcase and in front of the cylinder block.

20. The engine of claim 19, wherein the oil filter is situated vertically below the water pump.

21. A four-cycle engine for mounting in an engine room of a body of a snowmobile, the engine, comprising:

a crankcase having a crankshaft arranged along a body width direction of the snowmobile;

a cylinder block having a central axis which is tilted rearward with respect to a vertical direction of the body of the snowmobile;

an oil filter situated in front of the crankcase, the oil filter having an oil filter central axis which is oriented upwards and frontwards.

* * * * *